US008617356B2

(12) United States Patent
Duggirala et al.

(10) Patent No.: US 8,617,356 B2
(45) **Date of Patent: *Dec. 31, 2013**

(54) COMPOSITIONS AND PROCESSES FOR PAPER

(75) Inventors: Prasad Duggirala, Naperville, IL (US); Sergey Shevchenko, Aurora, IL (US)

(73) Assignee: Nalco Company, Naperville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/459,321

(22) Filed: Apr. 30, 2012

(65) Prior Publication Data

US 2012/0211185 A1 Aug. 23, 2012

Related U.S. Application Data

(63) Continuation-in-part of application No. 11/387,499, filed on Mar. 23, 2006, now Pat. No. 8,246,780.

(60) Provisional application No. 60/721,847, filed on Sep. 29, 2005, provisional application No. 60/718,475, filed on Sep. 19, 2005.

(51) Int. Cl.
*D21H 21/30* (2006.01)
*D21H 21/32* (2006.01)

(52) U.S. Cl.
CPC ..... *D21H 21/30* (2013.01); *D21H 21/32* (2013.01)
USPC ..... 162/160; 162/70; 162/82

(58) Field of Classification Search
CPC ..... D21H 21/30; D21H 21/32
USPC ..... 162/70, 82, 160
See application file for complete search history.

(56) References Cited

U.S. PATENT DOCUMENTS

| | | | | |
|---|---|---|---|---|
| 3,619,355 | A * | 11/1971 | Silberman | 162/135 |
| 5,368,689 | A * | 11/1994 | Agnemo | 162/135 |
| 8,183,310 | B2 * | 5/2012 | Naik et al. | 524/89 |
| 2002/0088574 | A1 * | 7/2002 | Seltzer et al. | 162/72 |
| 2007/0062653 | A1 * | 3/2007 | Duggirala et al. | 162/9 |

OTHER PUBLICATIONS

Smook, Handbook for Pulp and Paper Technologists, 1992, Angus Wilde Publications, 2nd edition, chapters 11 and 15.*
Shakhashri, Chemical Demonstrations, vol. 3, 1989, Univ of Wisconsin Press, p. 9.*
Lachenal, High Temperature Chlorine Dioixde Bleaching of Hardwood Kraft Pulp, 2000, Tappi Journal.*

* cited by examiner

*Primary Examiner* — Anthony Calandra
(74) *Attorney, Agent, or Firm* — Benjamin E. Carlsen; Andrew D. Sorensen

(57) ABSTRACT

Compositions and processes that enhance the brightness and improve color of pulp or paper when applied during different stages of the papermaking process involving optical brighteners are identified. Used in combination with optical brighteners and/or chelants the described agents produce a synergistic effect not previously identified in the paper process.

10 Claims, 3 Drawing Sheets

COMPOSITIONS AND PROCESSES FOR PAPER

CROSS-REFERENCE TO RELATED APPLICATIONS

This applications claims benefit of provisional patent application Nos. 60/721,847, Sep. 29, 2005 and 60/718,475, Sep. 19, 2005 and is a continuation in part of U.S. patent application Ser. No. 11/387,499 filed on Mar. 23, 2006 now U.S. Pat. No. 8,246,780.

STATEMENT REGARDING FEDERALLY SPONSORED RESEARCH OR DEVELOPMENT

Not Applicable.

BACKGROUND OF THE INVENTION

This invention relates to compositions and processes for improving brightness and optical properties in pulp and paper manufacture. More particularly, this invention concerns compositions, which in the presence of optical brightening agents effectively enhance the brightness and optical properties of a paper product.

Pulps produced by either mechanical or chemical pulping methods possess a color that can range from dark brown to creamish depending on the wood type and defibering process used. The pulp is bleached to produce white paper products for a multiplicity of applications.

Bleaching is the removal or chemical alteration of those light-absorbing components of unbleached pulp such that the amount of light they absorb after bleaching is greatly reduced. In the bleaching of mechanical pulp, the objective is to decolorize the pulp without solubilizing the lignin. Either reducing (e.g. sodium hydrosulfite) or oxidizing (e.g., hydrogen peroxide) bleaching agents are usually used. The bleaching is often a multistage process. The bleaching of chemical pulps is an extension of the delignification that started in the digestion stage, thus comprising lignin removal and chemical alteration. The bleaching is often a multistage process, which stages may include chlorine dioxide bleaching, oxygen-alkaline delignification, and peroxide bleaching.

In contrast to bleaching, application of optical brighteners changes the appearance of the paper not by altering the light absorbing materials, but instead by adding to the paper additional materials that fluoresce light in their own right. The industry invests significantly in chemicals such as bleaching agents and optical brighteners that improve optical properties of the finished paper or paper products. However, both approaches have their limits: it becomes uneconomical to bleach pulp beyond certain limits and it also tends to degrade and decrease mechanical properties of the resulting paper. Also excessive use of optical brighteners results in economic losses and in undesirable color changes. These two problems limit the degree of brightness improvement that can be achieved using conventional means.

Thus there is a clear need for and utility in a successful and practical solution to increase brightness paper made of bleached pulp. One of the approaches is to increase efficiency of optical brighteners. The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

BRIEF SUMMARY OF THE INVENTION

At least one embodiment of the invention is directed towards compositions and methods for improving brightness in the papermaking process. In an aspect, this invention is a method of making a paper product having enhanced brightness in presence of conventional optical brighteners comprising (1) providing a bleached pulp; (2) forming an aqueous stock suspension comprising bleached pulp; (3) draining the stock suspension to form a sheet; and (4) drying the sheet to form the paper product containing an optical brightener, wherein an effective amount of one or more reducing agents is added to the bleached pulp, to the stock suspension or on to the sheet.

In another aspect, this invention is a method of enhancing brightness comprising adding an effective amount of one or more reducing agents and optionally one or more chelants and one or more polycarboxylates to the bleached pulp material.

Applicant discovered that reducing agents in combination with chelants effectively enhance the brightness of paper products and further that reducing agents used in combination with optical brighteners enhance the effect of the optical brighteners and improve color scheme. Accordingly, in additional aspects, this invention is methods of using reducing agents in combination with chelants and/or optical brighteners to prepare bleached pulp materials having higher brightness, and improved color schemes. The reducing agent, optical brighteners and chelants may be used alone or in combination with known additives to enhance the quality of the desired paper product.

DETAILED DESCRIPTION OF THE INVENTION

Figure 1:
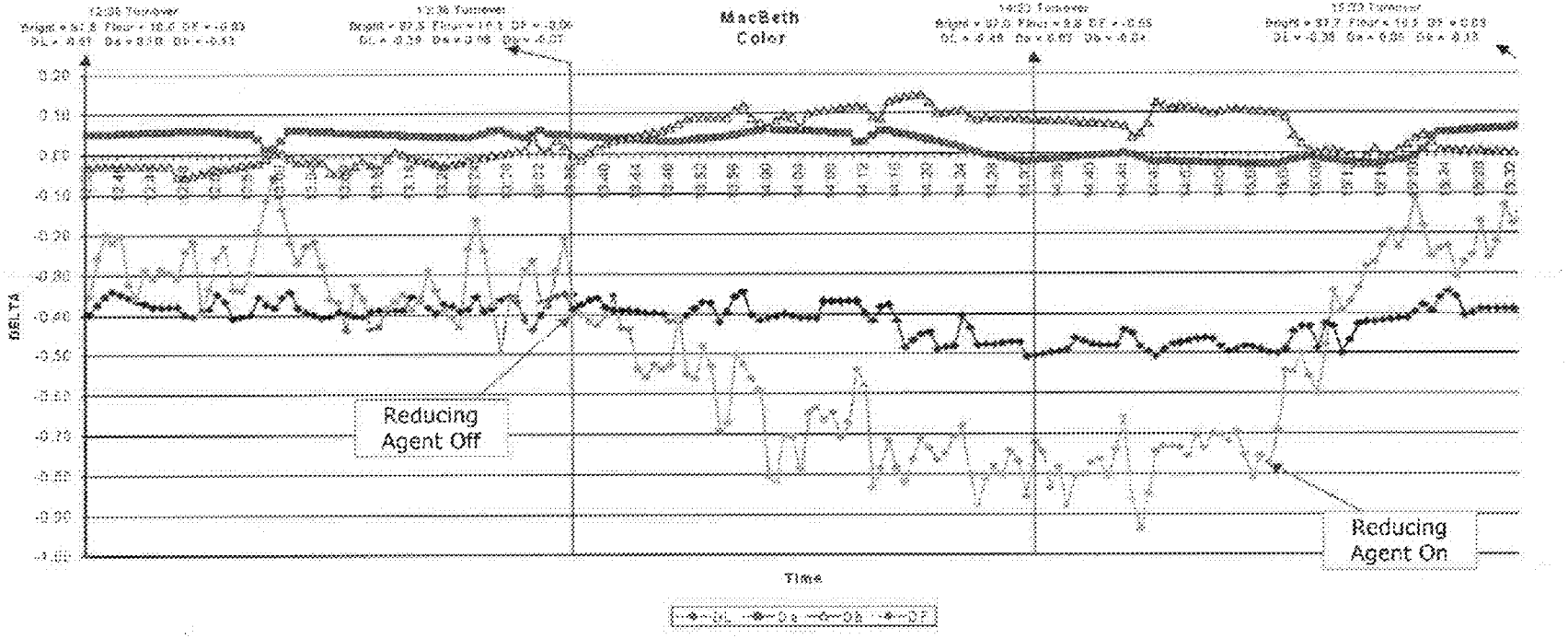
FIG. 1 is a first graphical representation of the effect of a reducing agent on OBA activation.

The following definitions are provided to determine how terms used in this application, and in particular how the claims, are to be construed. The organization of the definitions is for convenience only and is not intended to limit any of the definitions to any particular category.

"Brightness" means the whiteness of pulp or paper, on a scale from 0% (absolute black) to 100% (relative to a MgO standard, which has an absolute brightness of about 96% ) by the reflectance of blue light (457 nm) from the paper.

"Optical Brighteners (OBA)" means fluorescent dyes or pigments that absorb ultraviolet radiation and reemit it at a higher wave length in the visible spectrum (blue), thereby effecting a white, bright appearance to the paper sheet when added to the stock furnish. Representative optical brighteners include, but are not limited to azoles, biphenyls, coumarins; furans; ionic brighteners, including anionic, cationic, and anionic (neutral) compounds, such as the Eccobrite® and Eccowhite® compounds available from Eastern Color & Chemical Co. (Providence, R.I.); naphthalimides; pyrazenes; substituted (e.g., sulfonated) stilbenes, such as the Leucophor® range of optical brighteners available from the Clariant Corporation (Muttenz, Switzerland), and Tinopal® from Ciba Specialty Chemicals (Basel, Switzerland); salts of such compounds including but not limited to alkali metal salts, alkaline earth metal salts, transition metal salts, organic salts and ammonium salts of such brightening agents; and combinations of one or more of the foregoing agents.

"Thermal brightness loss" means brightness loss in paper and pulp under the influence of time, temperature and moisture (non-photochemical brightness loss).

"Brightness loss during storage" is means brightness loss over time under storage conditions.

"Yellowing" or "Reversion" means the loss of brightness of bleached pulp, paper, paperboard, paper tissue and related materials prepared from the bleached pulp over a period of time.

"Sulfites" mean dibasic metal salts of sulfurous acid, $H_2SO_3$, including dibasic alkali and alkaline earth metal salts such as sodium sulfite ($Na_2SO_3$), calcium sulfite ($CaSO_3$), and the like.

"Bisulfites" means monobasic metal salts of sulfurous acid, $H_2SO_3$, including alkali and alkaline earth metal monobasic salts such as sodium bisulfite ($NaHSO_3$), magnesium bisulfite ($Mg(HSO_3)_2$), and the like.

"Sulfoxylates" means salts of sulfoxylic acid, $H_2SO_2$, including zinc sulfoxylate ($ZnSO_2$), and the like.

"Metabisulfites (Pyrosulfites)" means salts of pyrosulfurous acid, $H_2S_2O_5$, including sodium metabisulfite ($Na_2S_2O_5$), and the like.

"Thiosulfates" means salts of thiosulfurous acid, $H_2S_2O_3$, including potassium thiosulfate ($Na_2S_2O_3$), and the like.

"Polythionates" means salts of polythionic acid, $H_2S_nO_6$ (n=2-6), including sodium trithionate ($Na_2S_3O_6$), salts of dithionic acid, $H_2S_2O_6$, such as sodium dithionate $Na_2S_2O_6$, and the like.

"Dithionites (hydrosulfites)" means salts of dithionous (hydrosulfurous, hyposulfurous) acid, $H_2S_2O_4$, including sodium dithionite (hydrosulfite) ($Na_2S_2O_4$), magnesium dithionite ($MgS_2O_4$), and the like.

"Formamidinesulfinic acid (FAS)" means a compound of formula $H_2NC(=NH)SO_2H$ and its salts and derivatives including the sodium salt $H_2NC(=NH)SO_2Na$.

"Aldehyde bisulfite adducts" means compounds of formula R1CH(OH)$SO_3H$ and metal salts thereof where $R_1$ is selected from alkyl, alkenyl, aryl and arylalkyl. Representative aldehyde bisulfite adducts include formaldehyde bisulfite adduct $HOCH_2SO_3Na$, and the like.

"Sulfinamides and ethers of sulfenic acid" means compounds of formula $R_1$—S(=O)—$R_2$, where $R_1$ is defined herein and $R_2$ is selected from $OR_3$ and $NR_4R_5$, where $R_3$-$R_5$ are independently selected from selected from alkyl, alkenyl, aryl and arylalkyl. Representative sulfinamides include ethylsulfindimethylamide ($CH_3CH_2S(=O)N(CH_3)_2$), and the like.

"Sulfenamides and ethers of sulfenic acid" means compounds of formula $R_1$—S—$R_2$, where $R_1$ and $R_2$ are defined above. Representative sulfenamides include ethylsulfendimethylamide ($CH_3CH_2SN(CH_3)_2$), and the like.

"Sulfamides" means compounds of formula $R_1$—C(=S)—$NR_4R_5$, where $R_1$, $R_4$ and $R_5$ are defined above. Representative sulfamides include $CH_3CH_2C(=S)N(CH_3)_2$, and the like.

"Phosphines" means derivatives of phosphine, $PH_3$, normally organic substituted phosphines of the formula $R_6R_7R_8P$ where $R_6$-$R_8$ are independently selected from H, alkyl, alkenyl, aryl, arylalkyl and $NR_4R_5$ where $R_4$ and $R_5$ is defined above. Representative phosphines include $(HOCH_2)_3P$ (THP), and the like.

"Phosphites" means derivatives of phosphorous acid $P(OH)_3$, including organic substituted phosphites of the formula $(R_3O)(R_4O)(R_5O)P$ where $R_3$-$R_5$ are defined above. Representative phosphites include $(CH_3CH_2O)_3P$, and the like.

"Thiophosphites" means derivatives of phosphorothious acid $HSP(OH)_2$, including organic substituted thiophosphites of formula $(R_3O)(R_4O)(R_5S)P$ where $R_3$-$R_5$ are defined above. Representative thiophosphites include $(CH_3CH_2O)_2(CH_3CH_2S)P$, and the like.

"Phosphonium salts" means organic substituted phosphines of the formula $R_1R_3R_4R_5P^+X^-$, where $R_1$ and $R_4$-$R_5$ are as defined above and X is any organic or inorganic anion. Representative phosphonium salts include $(HO_2CCH_2CH_2)_3P^+HCl^-$(THP), $[(HOCH_2)_4P^+]_2(SO_4)^{2-}$ (BTHP), and the like.

"Alkenyl" means a monovalent group derived from a straight or branched hydrocarbon containing at least one carbon-carbon double bond by the removal of a single hydrogen atom. The alkenyl may be unsubstituted or substituted with one or more groups selected from amino, alkoxy, hydroxy and halogen.

"Alkoxy" means an alkyl group attached to the parent molecular moiety through an oxygen atom. Representative alkoxy groups include methoxy, ethoxy, propoxy, butoxy, and the like. Methoxy and ethoxy are preferred.

"Alkyl" means a monovalent group derived from a straight or branched chain saturated hydrocarbon by the removal of a single hydrogen atom. The alkyl may be unsubstituted or substituted with one or more groups selected from amino, alkoxy, hydroxy and halogen. Representative alkyl groups include methyl, ethyl, n- and iso-propyl, n-, sec-, iso- and tert-butyl, and the like.

"Alkylene" means a divalent group derived from a straight or branched chain saturated hydrocarbon by the removal of two hydrogen atoms, for example methylene, 1,2-ethylene, 1,1-ethylene, 1,3-propylene, 2,2-dimethylpropylene, and the like.

"Amino" means a group of formula —$NY_1Y_2$ where $Y_1$ and $Y_2$ are independently selected from H, alkyl, alkenyl, aryl and arylalkyl. Representative amino groups include amino (—NH2), methylamino, ethylamino, isopropylamino, diethylamino, dimethylamino, methylethylamino, and the like.

"Aryl" means aromatic carbocyclic radicals and heterocyclic radicals having about 5 to about 14 ring atoms. The aryl may be unsubstituted or substituted with one or more groups selected from amino, alkoxy, hydroxy and halogen. Representative aryl include phenyl, naphthyl, phenanthryl, anthracyl, pyridyl, furyl, pyrrolyl, quinolyl, thienyl, thiazolyl, pyrimidyl, indolyl, and the like. "Arylalkyl" means an aryl group attached to the parent molecular moiety through an alkylene group. Representative arylalkyl groups include benzyl, 2-phenylethyl, and the like.

"Halo" and "halogen" mean chlorine, fluorine, bromine and iodine.

"Salt" means the metal, ammonium, substituted ammonium or phosphonium salt of an inorganic or organic anionic counterion. Representative metals include sodium, lithium, potassium, calcium, magnesium, and the like. Representative anionic counterions include sulfite, bisulfite, sulfoxylate, metabisulfite, thiosulfate, polythionate, hydrosulfite, formamidinesulfinate, and the like.

"Organic phosphonates" means organic derivatives of phosphonic acid, $HP(O)(OH)_2$, containing a single C—P bond, such as HEDP ($CH_3C(OH)(P(O)(OH)_2)$, 1-hydroxy-1, 3-propanediylbis-phosphonic acid ($(HO)_2P(O)CH(OH)CH_2CH_2P(O)(OH)_2$)); preferably containing a single C—N bond adjacent (vicinal) to the C—P bond, such as DTMPA ($(HO)_2P(O)CH_2N[CH_2CH_2N(CH_2P(O)(OH)_2)_2]_2$), AMP ($N(CH_2P(O)(OH)_2)_3$), PAPEMP ($(HO)_2P(O)CH_2)_2NCH(CH_3)CH_2(OCH_2CH(CH_3))_2N(CH_2)_6N(CH_2P(O)(OH)_2)_2$), HMDTMP ($(HO)_2P(O)CH_2)_2N(CH_2)_6N(CH_2P(O)(OH)_2)_2$), HEBMP ($N(CH_2P(O)(OH)_2)_2CH_2CH_2OH$), and the like.

"Organic phosphates" means organic derivatives of phosphorous acid, $P(O)(OH)_3$, containing a single C—P bond, including triethanolamine tri(phosphate ester) ($N(CH_2CH_2OP(O)(OH)_2)_3$), and the like.

"Carboxylic acids" means organic compounds containing one or more carboxylic group(s), —C(O)OH, preferably aminocarboxylic acids containing a single C—N bond adjacent (vicinal) to the C—$CO_2H$ bond, such as EDTA ($(HO_2CCH_2)_2NCH_2CH_2N(CH_2CO_2H)_2$), DTPA ($(HO_2CCH_2)_2NCH_2CH_2N(CH_2CO_2H)CH_2CH_2N(CH_2CO_2H)_2$), and the like and alkaline and alkaline earth metal salts thereof.

"Dithiocarbamates" include monomeric dithiocarbamates, polymeric dithiocarbamates, polydiallylamine dithiocarbamates, 2,4,6-trimercapto-1,3,5-triazine, disodium ethylenebisdithiocarbamate, disodium dimethyldithiocarbamate, and the like.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims.

In at least one embodiment is provided an improved process for making paper and paper products exhibiting high optical brightness. Brightness enhancement and color improvement of bleached pulp and paper product prepared from the bleached pulp can be achieved by adding one or more reducing agents as defined herein to pulp, paper, paperboard or tissue anywhere in the papermaking process.

Without being limited by theory or design nor the scope afforded in construing the claims, it is believed that the reducing agents activate OBA by suppressing the effects of light quenching groups. Paper contains a number of groups such as carbonyl groups in hemicelluloses which photophysically interact with OBA and absorb some the light emitted by OBA. As a result, OBA-brightened paper has lower light emissions than the same amount of OBA emits in the absence of paper. In at least one embodiment the reducing agent chemically alters fluorescene-quenching groups in paper such that more or all of the light emitted by the OBA is released from the paper.

The reducing agents described herein are suitable for use on any bleached pulp material used in papermaking processes and any paper product prepared from the bleached pulp. As used herein, "bleached pulp material" means bleached pulp and paper products prepared from the bleached pulp including paper, paperboard, tissue, and the like.

Reducing agents according to this invention include chemical substances capable of transform functional groups in the bleached pulp from a higher oxidation category to a lower oxidation category. The benefits of this transformation include increased brightness stability in the paper machine and enhanced performance of optical brighteners.

In an embodiment, the reducing agents are selected from the group consisting of sulfites, bisulfites, metabisulfites (pyrosulfites), sulfoxylates, thiosulfates, dithionites (hydrosulfites), polythionates, formamidinesulfinic acid and salts and derivatives thereof, formaldehyde bisulfite adduct and other aldehyde bisulfite adducts, sulfinamides and ethers of sulfinic acid, sulfenamides and ethers of sulfenic acid, sulfamides, phosphines, phosphonium salts, phosphites, and thiophosphites.

In an embodiment, the reducing agent is selected from the group consisting of substituted phosphines, sulfites, bisulfites and metabisulfites.

In an embodiment, the reducing agent is sodium bisulfite.

The process of the present invention can be practiced on conventional papermaking equipment. Although papermaking equipment varies in operation and mechanical design, the processes by which paper is made on different equipment contain common stages. Papermaking typically includes a pulping stage, bleaching stage, stock preparation stage, a wet end stage and a dry end stage.

In the pulping stage, individual cellulose fibers are liberated from a source of cellulose either by mechanical or chemical action, or both. Representative sources of cellulose include, but are not limited to, wood and similar "woody" plants, soy, rice, cotton, straw, flax, abaca, hemp, bagasse, lignin-containing plants, and the like, as well as original and recycled paper, paper tissue and paperboard. Such pulps include, but are not limited to, groundwood (GWD), bleached groundwood, thermomechanical pulps (TMP), bleached thermomechanical pulps, chemi-thermomechanical pulps (CTMP), bleached chemi-thermomechanical pulps, deinked pulps, kraft pulps, bleached kraft pulps, sulfite pulps, and bleached sulfite pulps. Recycled pulps may or may not be bleached in the recycling stage, but they are presumed to be originally bleached. Any of the pulps described above which have not previously been subjected to bleaching may be bleached as described herein to provide a bleached pulp material.

In an embodiment, the bleached pulp material is selected from the group consisting of virgin pulp, recycled pulp, kraft, sulfite pulp, mechanical pulp, any combination of such pulps, recycled paper, paper tissue, and any paper made from such listed pulps or combinations thereof.

A further advantage of this invention is that it allows for substituting lower-priced mechanical pulp for higher priced kraft in printing grade kraft-mechanical paper. Use of the chemistry and methods described herein increases the brightness and stability toward yellowing, therefore permitting the use of higher amounts of mechanical pulp, with corresponding reduction in cost, without loss of quality in the resulting paper product.

The pulp, is suspended in water in the stock preparation stage. Additives such as brightening agents, dyes, pigments, fillers, antimicrobial agents, defoamers, pH control agents and drainage aids also may be added to the stock at this stage. As the term is used in this disclosure, "stock preparation" includes such operations as dilution, screening and cleaning of the stock suspension that may occur prior to forming of the web.

The wet end stage of the papermaking process comprises depositing the stock suspension or pulp slurry on the wire or felt of the papermaking machine to form a continuous web of fibers, draining of the web and consolidation of the web ("pressing") to form a sheet. Any papermaking machine known in the art is suitable for use with the process of the present invention. Such machines may include cylinder machines, fourdrinier machines, twin wire forming machines, tissue machines, and the like, and modifications thereof.

In the dry end stage of the papermaking process, the web is dried and may be subjected to additional processing like size pressing, calendering, spray coating with surface modifiers, printing, cutting, corrugating and the like. In addition to a size press and calender waterbox, the dried paper can be coated by spray coating using a sprayboom.

In at least one embodiment, the reducing agent is added after the wetend of the papermaking process. In at least one embodiment, the reducing agent is added immediately before the dryend of the papermaking process. Adding reducing agents at this late stage of the papermaking process is quite rare. At this point the paper is very dense (it is no longer slurry) as most of the water has been removed. In contrast most chemical additives are added much earlier when the paper contains more water and the additive will be diluted. Moreover, the volume concentration is quickly increased in a dryer where the temperature is also high. These conditions ensure quick and complete reaction of the chemicals with pulp resulting in the activation of the OBA.

Applicant has also discovered that reducing agents in combination with chelants as described below effectively enhance the brightness of a paper product via increased thermal stability of the pulp and reduction of chromophoric structures in pulp.

In an embodiment, one or more chelants are added to the bleached pulp or paper product. Suitable chelants according to this embodiment include compounds that are capable of chelating transitional metals that form colored products with pulp constituents and catalyze color-forming reactions in the bleached pulp or paper products.

In an embodiment, the chelant is a compound selected from the group consisting of organic phosphonate, phosphate, carboxylic acids, dithiocarbamates, salts of any of the previous members, and any combination thereof.

In an embodiment, the chelant is a phosphonate.

In an embodiment, the phosphonate is diethylene-triamine-pentamethylene phosphonic acid (DTMPA) and salts thereof.

In an embodiment, the chelant is a carboxylic acid.

In an embodiment, the carboxylate is selected from diethylenetriaminepentaacetic acid (DTPA) and salts thereof and ethylenediaminetetraacetic acid (EDTA) and salts thereof.

Applicant has also discovered that reducing agents used in combination with optical brighteners ("OBA's") enhance the effect of optical brighteners (OBA). The reducing agents also improve the color scheme. This permits reduction of the amount of OBA's and brighteners such as blue dyes necessary to achieve comparable brightness and color. Replacing some of the OBA and dyes with reducing agents allows pulp and paper manufacturers to reduce production costs and reduce the overall amount of OBA and dyes present, while maintaining an acceptable level of brightness in the paper product and achieving the target color. In some cases it may be possible to eliminate dyes entirely and maintain color.

Accordingly, in another embodiment, one or more optical brighteners ("OBA's") are added to the bleached pulp or paper product.

In an embodiment, the optical brighteners are selected from the group of disulfonated, tetrasulfonated and hexasulfonated Tinopal® OBAs.

The dosage of reducing agents, chelants and/or optical brighteners is the amount necessary to achieve the desired brightness and resistance to yellowing of the bleached pulp or paper product prepared from the bleached pulp and can be readily determined by one of skill in the art based on the characteristics of chelant or optical brightener, the pulp or paper being treated and the method of application.

The effective amount of reducing agent added to the bleached pulp or paper product is the amount of reducing agent which enhances the brightness of the pulp or paper compared to pulp or paper which is not treated with the reducing agents. Methods for determining brightness are described herein.

Typically, about 0.005 to about 2, preferably about 0.05 to about 0.25 weight percent, based on oven-dried pulp of reducing agent is added to the bleached pulp or paper product.

In a typical application, about 0.001 to about 1, preferably about 0.01 to about 0.1 weight percent of phosphonate, phosphate or carboxylic acid chelant and/or about 0.002 to about 0.02 weight percent of dithiocarbamates chelant based on oven-dried pulp is added to the bleached pulp or paper product.

Optical brighteners are typically added in amounts of about 0.005 to about 2, preferably 0.05 to about 1 weight percent of optical brightener based on oven-dried pulp.

The reducing agents, chelants and/or optical brighteners can be added to bleached pulp or paper at any point in the papermaking or tissue making process. Representative addition points include, but are not limited to (a) to the pulp slurry in the latency chest; (b) to the pulp after the bleaching stage in a storage, blending or transfer chest; (c) to pulp after bleaching, washing and dewatering followed by cylinder or flash drying; (d) before or after the cleaners; (e) before or after the fan pump to the paper machine headbox; (f) to the paper machine white water; (g) to the silo or save all; (h) in the press section using, for example, a size press, coater or spray bar; (i) in the drying section using, for example, a size press, coater or spray bar; (j) on the calender using a wafer box; and/or (k) on paper in an off-machine coater or size press; and/or (l) in the curl control unit.

The precise location where the reducing agents, chelants and/or optical brighteners should be added will depend on the specific equipment involved, the exact process conditions being used and the like. In some cases, the reducing agents, chelants and/or optical brighteners may be added at one or more locations for optimal effectiveness.

Application can be by any means conventionally used in papermaking processes, including by "split-feeding" whereby a portion of the reducing agent, chelant and/or optical brightener is applied at one point in the papermaking process, for example on pulp or a wet sheet (before the dryers) and the remaining portion is added at a subsequent point, for example in the size press.

The chelant and/or optical brightener can be added to the bleached pulp or paper product before, after or simultaneously with the reducing agent. The optical brightener and/or chelant may also be formulated with the reducing agent.

In an embodiment, one or more reducing agents and one or more optical brighteners are mixed with the surface sizing solution and applied in the size press.

In an embodiment, the reducing agent is added to bleached pulp after the bleaching stage in the storage, blending or transfer chest.

At these various locations, the reducing agents, chelants and/or optical brighteners can also be added with a carrier or additive typically used in paper making, such as retention aids, sizing aids and solutions, starches, precipitated calcium carbonate, ground calcium carbonate, or other clays or fillers, and brightening additives.

In an embodiment, the reducing agents, chelants and/or optical brighteners are used in combination with one or more partially neutralized polycarboxylic acids, preferably polycarboxylic acids such as polyacrylic acid ($CH_3CH(CO_2H)[CH_2CH(CO_2H)]_nCH_2CH_2CO_2H$, where n is about 10 to about 50,000. The polycarboxylic acid may be neutralized to the target pH, (typically 5-6 as discussed below) with alkali such as sodium hydroxide.

In an embodiment, this invention is a formulation comprising one or more chelants, one or more reducing agents and one or more polycarboxylic acids. The formulation preferably has a pH of about 4-7, more preferably about 5-6.

In an embodiment, this invention is a formulation comprising one or more reducing agents and one or more optical brighteners and optionally one or more chelants or one or more polycarboxylates, or combinations thereof. Formulations according to this embodiment preferably have a pH of about 7-11, more preferably about 9-10.

The reducing agents, chelants and optical brighteners and polycarboxylates may be used in addition to other additives conventionally used in papermaking to improve one or more properties of the finished paper product, assist in the process of manufacturing the paper itself, or both. These additives are generally characterized as either functional additives or control additives.

Functional additives are typically those additives that are use to improve or impart certain specifically desired properties to the final paper product and include but are not limited to brightening agents, dyes, fillers, sizing agents, starches, and adhesives.

Control additives, on the other hand, are additives incorporated during the process of manufacturing the paper so as to improve the overall process without significantly affecting the physical properties of the paper. Control additives include biocides, retention aids, defoamers, pH control agents, pitch control agents, and drainage aids. Paper and paper products made using the process of the present invention may contain one or more functional additives and/or control additives.

Pigments and dyes impart color to paper. Dyes include organic compounds having conjugated double bond systems; azo compounds; metallic azo compounds; anthraquinones; triaryl compounds, such as triarylmethane; quinoline and related compounds; acidic dyes (anionic organic dyes containing sulfonate groups, used with organic rations such as alum); basic dyes (cationic organic dyes containing amine functional groups); and direct dyes (acid-type dyes having high molecular weights and a specific, direct affinity for cellulose); as well as combinations of the above-listed suitable dye compounds. Pigments are finely divided mineral that can be either white or colored. The pigments that are most commonly used in the papermaking industry are clay, calcium carbonate and titanium dioxide.

Fillers, are added to paper to increase opacity and brightness. Fillers include but are not limited to calcium carbonate (calcite); precipitated calcium carbonate (PCC); calcium sulfate (including the various hydrated forms); calcium aluminate; zinc oxides; magnesium silicates, such as talc; titanium dioxide ($TiO_2$), such as anatase or rutile; clay, or kaolin, consisting of hydrated $SiO_2$ and $Al_2O_3$; synthetic clay; mica; vermiculite; inorganic aggregates; perlite; sand; gravel; sandstone; glass beads; aerogels; xerogels; seagel; fly ash; alumina; microspheres; hollow glass spheres; porous ceramic spheres; cork; seeds; lightweight polymers; xonotlite (a crystalline calcium silicate gel); pumice; exfoliated rock; waste concrete products; partially hydrated or unhydrated hydraulic cement particles; and diatomaceous earth, as well as combinations of such compounds.

Sizing agents are added to the paper during the manufacturing process to aid in the development of a resistance to penetration of liquids through the paper. Sizing agents can be internal sizing agents or external (surface) sizing agents, and can be used for hard-sizing, slack-sizing, or both methods of sizing. More specifically, sizing agents include rosin; rosin precipitated with alum ($Al_2(SO_4)_3$); abietic acid and abietic acid homologues such as neoabietic acid and levopimaric acid; stearic acid and stearic acid derivatives; ammonium zirconium carbonate; silicone and silicone-containing compounds, such as RE-29 available from GE-OS1 and SM-8715, available from Dow Corning Corporation (Midland, Mich.); fluorochemicals of the general structure $CF_3(CF_2)_nR$, wherein R is anionic, cationic or another functional group, such as Gortex; alkylketene dimer (AKD), such as Aquapel 364, Aquapel (I 752, Heron) 70, Hercon 79, Precise 787, Precise 2000, and Precise 3000, all of which are commercially available from Hercules, Incorporated (Willmington, Del.); and alkyl succinic anhydride (ASA); emulsions of ASA or AKD with cationic starch; ASA incorporating alum; starch; hydroxymethyl starch; carboxymethylcellulose (CMC); polyvinyl alcohol; methyl cellulose; alginates; waxes; wax emulsions; and combinations of such sizing agents.

Starch has many uses in papermaking. For example, it functions as a retention agent, dry-strength agent and surface sizing agent. Starches include but are not limited to amylose; amylopectin; starches containing various amounts of amylose and amylopectin, such as 25% amylose and 75% amylopectin (corn starch) and 20% amylose and 80% amylopectin (potato starch); enzymatically treated starches; hydrolyzed starches; heated starches, also known in the art as "pasted starches"; cationic starches, such as those resulting from the reaction of a starch with a tertiary amine to form a quaternary ammonium salt; anionic starches; ampholytic starches (containing both cationic and anionic functionalities); cellulose and cellulose derived compounds; and combinations of these compounds.

The method of this invention yields paper products with a bright surface.

As stated for example in the *Handbook for Pulp and Paper Technologists*, by Gary A. Smook, Angus Wilde Publications Inc., (2001), as well as in U.S. Pat. No. 5,035,772, and European Patent 0905317, one of the key differences between Kraft pulp and other forms of pulp is that in Kraft pulp, substantially all of the lignin present in the wood chips used to make pulp, is removed by the pulping process. In at least one embodiment excluded from the invention are pulps in which substantially all of the lignin is not removed from the pulp.

As stated for example in the article *Thermal Yellowing of Hardwood Kraft Pulp Bleached with a Chlorine Dioxide Sequence*, by A. V. Tran, Journal of Pulp and Paper Science, Volume 28, Number 4, April (2002). The processes of photoyellowing and thermal yellowing are based on significantly differing chemistries and are different. In at least one embodiment the pulp is susceptible to thermal yellowing but not photoyellowing.

At least one embodiment of the invention is aimed at activation of an OBA within a pulp material. As previously stated, OBA is commonly used to brighten pulp. The effectiveness of these OBAs at brightening pulp or of brightening the resulting paper made from the pulp however is not constant. This effectiveness can be improved when the OBA is activated during the pulping and/or the papermaking process.

At least one embodiment of the invention is a method of activating an optical brightening agent. The method comprises the steps of contacting pulp or paper material containing or later treated with an optical brightening material with one or more reducing agents. The reducing agent may be one selected from the list consisting of sulfites, bisulfites, metabisulfites (pyrosulfites), sulfoxylates, thiosulfates, dithionites (hydrosulfites), polythionates, formamidinesulfinic acid and salts and derivatives thereof formaldehyde bisulfite adduct and other aldehyde bisulfite adducts, sulfinamides and ethers of sulfinic acid, sulfenamides and ethers of sulfenic acid, sulfamides, phosphites, and thiophosphites. The bisulfites are selected from monobasic metal salts of sulfurous acid and said sulfites are selected from dibasic metal salts of sulfurous acid provided said reducing agents are not used in combination with an acid of formula:

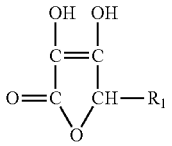

where $R_1$=—$CHOHCH_2OH$ or —CHOHCOOH, or salts thereof. The optical brightening agent may be added to substantially lignin free bleached kraft pulp material. The optical brightening agent may be added to bleached pulp material in a papermaking or tissue making process with about 0.005 to about 0.08 weight percent, based on oven-dried pulp material of one or more reducing agents wherein the reducing agents are added to the bleached pulp material (a) in a blending or transfer chest; (b) before or after the cleaners; (c) before or after the fan pump to the paper machine headbox; (d) to the paper machine white water; (e) to the silo or save all; (f) in the press section; (g) in the size press (sizing solution) or (h) in the curl control unit. The optical brightening agent and the reducing agent may be contacted with each other before they are added to the pulp. The optical brightening agent may exhibits at least a 1% improvement in brightness relative to its brightness in the absence of the reducing agent. The reducing agent may be added after a wet-end of the papermaking process is complete. The reducing agent may be added after more than 90% of the water has been removed from the paper sheet. The reducing agent may chemically alter at least one quenching group in the paper such that the quenching group absorbs less of the light that is emitted by the optical brightening agent. The quenching group may be a carbonyl group in the hemicellulose component of the pulp. The paper may have a white appearance and the amount of light emitted by the optical brightening agent is equivalent to an amount of light that if emitted in the absence of the reducing agent would be emitted only by a dosage of optical brightening agent that would cause the paper to have a non-white appearance. This non-white appearance may be one or more shades of blue and/or green. The paper may be made from bleached pulp or from non-bleached pulp.

At least one embodiment of the invention is a formulation comprising one or more reducing agents and one or more optical brighteners and optionally one or more chelants, one or more polycarboxylates, or combinations thereof.

EXAMPLES

The foregoing may be better understood by reference to the following examples, which are presented for purposes of illustration and are not intended to limit the scope of the invention.

TABLE 1

Representative Compositions (water not included)

| | Component | % Component |
|---|---|---|
| Composition A | DTMPA | 7.6 |
| | Sodium polyacrylate | 3.5 |
| | NaOH | 1.5 |
| | Sodium Metabisulfite | 26.6 |
| Composition B | DTMPA | 9.0 |
| | NaOH | 3.6 |
| | Sodium Metabisulfite | 27 |
| Composition C | DTMPA | 6.0 |
| | NaOH | 3.0 |
| | Sodium Metabisulfite | 30 |
| Composition D | DTMPA | 5.0 |
| | DTPA | 4.1 |
| | NaOH | 1.5 |
| | Sodium Metabisulfite | 30 |
| Composition E | DTMPA | 7.4 |
| | NaOH | 5.5 |
| | Sodium Metabisulfite | 16.7 |
| | FAS | 7.7 |
| Composition F | DTMPA | 4.2 |
| | NaOH | 2.8 |
| | Sodium Metabisulfite | 19.9 |
| | THPS | 9.8 |
| | DTPA | 4.1 |
| | $NaNO_2$ | 0.1 |
| Composition G | DTPA | 2.9 |
| | Sodium polyacrylate | 1.0 |
| | NaOH | 1.3 |
| | Sodium Metabisulfite | 30.0 |

In these Examples, sufficient 50% aqueous sodium hydroxide was added to achieve appropriate pH for the agent or composition being tested. All percentages in these examples are given on a weight percent dry pulp basis.

In these Examples, the following terms shall have the indicated meaning. Br for ISO brightness R457 (TAPPI 525); Ye for E313 yellowness; Im Br for R457 brightness after the application; TA Br for R457 brightness after thermal aging; TA loss for loss in brightness after thermal aging; % Inh. for % Inhibition of brightness loss: % Inh.=100-100*(ImBr-TABr)/$(ImBr\text{-}TABr)_{control}$; WI for E313 Whiteness: TMP for thermomechanical pulp; CTMP for chemi-thermomechanical pulp; RMP for refiner mechanical pulp; OBA for optical brightener; FAS for formamidinesulfinic acid; TCP for $(HOCH_2CH_2)_3PHCl$, tris-carboxyethylphosphonium hydrochloride; BTHP for $[(HOCH_2)_4P]_2(SO_4)$, tetra-hydroxymethylphosphonium sulfate; THP for $(HOCH_2)_3P$, tris-hydroxymethylphosphine; EDTA for $(HO_2CCH_2)_2NCH_2CH_2N(CH_2CO_2H)_2$, ethylenediaminetetraacetic acid; DTPA for $(HO_2CCH_2)_2NCH_2CH_2N(CH_2CO_2H)CH_2CH_2N(CH_2CO_2H)_2$, diethylenetriaminepentaacetic acid; DTMPA for $H_2O_3PCH_2N[CH_2CH_2N(CH_2PO_3H_2)_2]_2$, diethylene-triamine-pentamethylene phosphonic acid; and DTC for sodium dimethyldithiocarbamate.

Treatment

Handsheets were made of bleached pulp and then used in the experiments, in which the reducing agents were applied either on a wet sheet (before or after the press) before drum-drying or after drum-drying (temperature during drum drying: 100° C.). The third option was split-feed application. The surface sizing application was followed by one more round on a drum dryer.

The load of the tested Agent or Composition solution was determined based on the dry weight of the pulp sample. The Agent or Composition solutions were applied using a rod, as uniformly as possible, as solutions in water. The test sheets were dried using a laboratory drum drier under uniform conditions (one round) and then, after measuring the brightness, subjected to the accelerated aging tests as described below.

Test Equipment:

Laboratory drum drier.

"Elrepho 3000," "Technidyne Color Touch 2 (Model ISO)" or another instrument for brightness measurements.

Hitachi F-4500 fluorescence spectrometer or another instrument for relative fluorescence intensity measurements.

Micropipette.

Surface size application kit (pad and size 3-application rod).

Constant humidity room (23° C., 50% humidity).

Dry Surface Application Procedure (Surface Sizing):

1. Prepare 8×8-inch hand sheet according to the standard procedure. The target dry weight is 2.5 g. Pass wet hand sheets through one cycle on the drum dryer.
2. Cut the sheets into 4 smaller squares (approximate wt of 0.625 g each).
3. Tape one side of the smaller square (test sheet) to a glass pad using Scotch tape of length greater than the side of the sheet.
4. The application rod is placed on the scotch tape and a volume of 0.2 ml of the mix is applied on the tape against the rod using a micropipette.
5. The agent solution is applied in such away that it is evenly distributed on the tape to cover the entire test sheet.
6. Quickly draw the solution from the tape over sheet using the rod so that the reducing agent compound solution is evenly applied on to the entire sheet.
7. Drum-dry the test sheet and equilibrate at room temperature.
8. Measure brightness and yellowness.

Dry Surface Application Procedure (Surface Sizing, Soaking Method):

1. Prepare 8×8-inch hand sheet according to the standard procedure. The target dry weight is 2.5 g. Pass wet hand sheets through one cycle on the drum dryer.
2. Cut ⅛th strip of the sheet (0.31 g).
3. In a 50 ml test tube, prepare solutions of pre-cooked starch (if needed) and reducing agent compound solutions based on the pre-determined pickup rate and target dose.
4. Dip the paper strip into the solution for 10 seconds, let it drip for 35 seconds and then pass it through the press.
5. Drum-dry the test sheet and equilibrate at room temperature.
6. Measure brightness and yellowness.

Wet End Application Procedure:

1. An 8×8-inch sheet is made and dewatered using the press with two blotters at the bottom and one blotter on top. The consistency of the pressed sheet is around 40%.
2. The top blotter and the bottom most blotter are removed from the sheet after the press.
3. The sheet along with one bottom blotter are cut into 4 smaller test sheets of equal size (approximate dry weight of the sheet is 0.625 g).
4. The test sheet is taped along with the blotter to the glass pad as described in the "dry surface application procedure."
5. Solution 1 is applied as described in the dry surface application procedure.
6. After application, the test sheet along with the wet blotter is removed from the glass pad, the tape is removed and the blotter is separated from the test sheet. The blotter is discarded.
7. The test sheet is then drum dried and equilibrated at room temperature.

Split Feed Application Procedure:

1. An 8×8-inch sheet is made according to the standard procedure.
2. The sheet formed on the screen is then padded with 4 blotters.
3. The sheet along with blotters is then couched using a heavy metal roller. This process removes excess water from the sheet to increase the consistency of the sheet to around 20%.
4. Three top blotters are removed from the sheet.
5. The sheet and one blotter are then removed from the screen and cut into 4 smaller pieces as described in the "Wet end Application Procedure".
6. The sheet and the blotter are then taped to the glass pad as described in the "Wet end Application Procedure".
7. Solution 2 is applied as described in the "Wet end Application Procedure".
8. The test sheet is then pressed with 2 blotters on each side.
9. After press, all the blotters are removed and the sheet is drum dried. Solution 2 is then applied to the sheet, dried and measured as described in steps 3 to 8 of "Dry Surface Application Procedure".

Pulp Application Procedure:

The chemicals were added directly to the pulp (thin stock or thick stock) and mixed with the pulp in sealed bags. In a pulp application procedure for OBA enhancement the chemicals were added directly to the bleached kraft pulp at 20% consistency, mixed with the pulp in sealed bags and kept at 45-80° C. for 30 min. The pulp was diluted to 5% consistency, the OBA was added, mixed with the pulp, and the slurry was kept at 50° C. for 20 min. Then the slurry was further diluted and hand sheets prepared according to the standard procedure.

Testing Results

The trial data were collected at a kraft mill. The table below gives sample data. In several tests, application of the product (Composition A) in a size press, with an OBA in the sizing solution, at 5 lb/t and higher doses consistently provided a 1.5-point brightness increase accompanied by improved color of the paper sheet (reflected in decreasing DE values). Returning to the standard mill conditions (no penetrant composition applied) resulted in a decrease of brightness to the background level. This experiment was reproduced three times.

TABLE 2

Trial Data: R457 Brightness, E313 Whiteness, $DE(\Delta E) = \text{Sq. rt. } [(L_0 - L)^2 + (a_0 - a)^2 + (b_0 - b)^2]$

| Time, h. | Dose, lb/t | Brightness | DE | WI E313 |
|---|---|---|---|---|
| 0 | 0 | 94.5 | 1.99 | 142.24 |
| 0.58 | 0 | 94.5 | 1.61 | 144.95 |
| 1.17 | 0 | 94.5 | 1.83 | 143.34 |
| 1.75 | 0 | 94.5 | 1.93 | 143.52 |
| 2.33 | 0 | 94.5 | 1.52 | 146.66 |
| 2.92 | 4 | 95.25 | 0.71 | 150 |
| 3.5 | 4 | 95.25 | 0.89 | 148.29 |
| 4.08 | 4 | 95.5 | 0.88 | 148.4 |
| 4.67 | 5 | 96 | 0.76 | 149.46 |
| 5.25 | 5 | 96 | 0.72 | 149.84 |
| 5.83 | 6 | 96 | 0.44 | 152.6 |
| 6.42 | 8 | 96 | 0.44 | 156.01 |
| 7 | 8 | 96 | 0.35 | 154.15 |
| 7.58 | 8 | 95.75 | 0.4 | 154.92 |
| 8.17 | 10 | 96 | 0.52 | 152.24 |

Several compositions were tested and gave good results in laboratory simulation of the PM application. The chemicals (compositions) not listed in Table 1 were applied as 40% solutions.

Example 2

A Reducing agent trial was performed on a Paper Machine. The trial confirmed the benefits of adding reducing agents to OBA.

Figure 2:
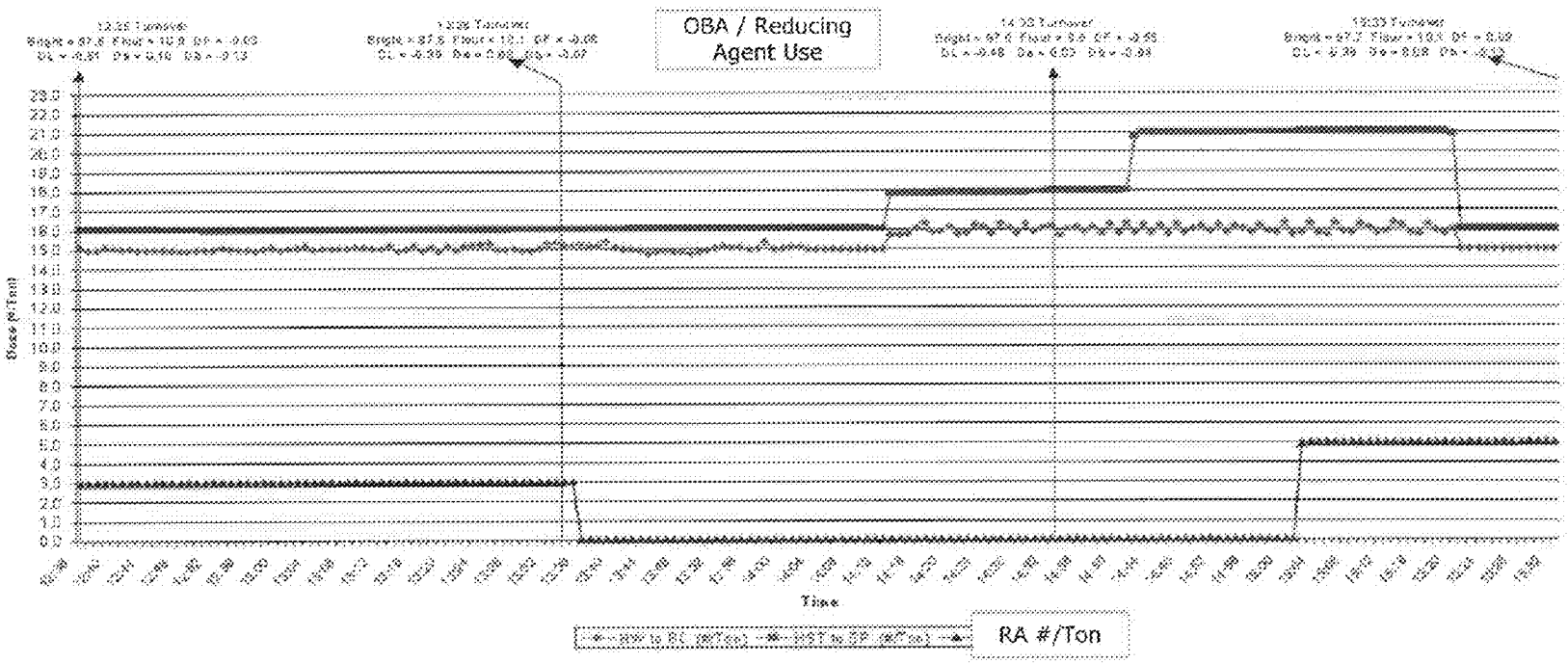
FIG. 2 is a second graphical representation of the effect of a reducing agent on OBA activation.
Figure 3:
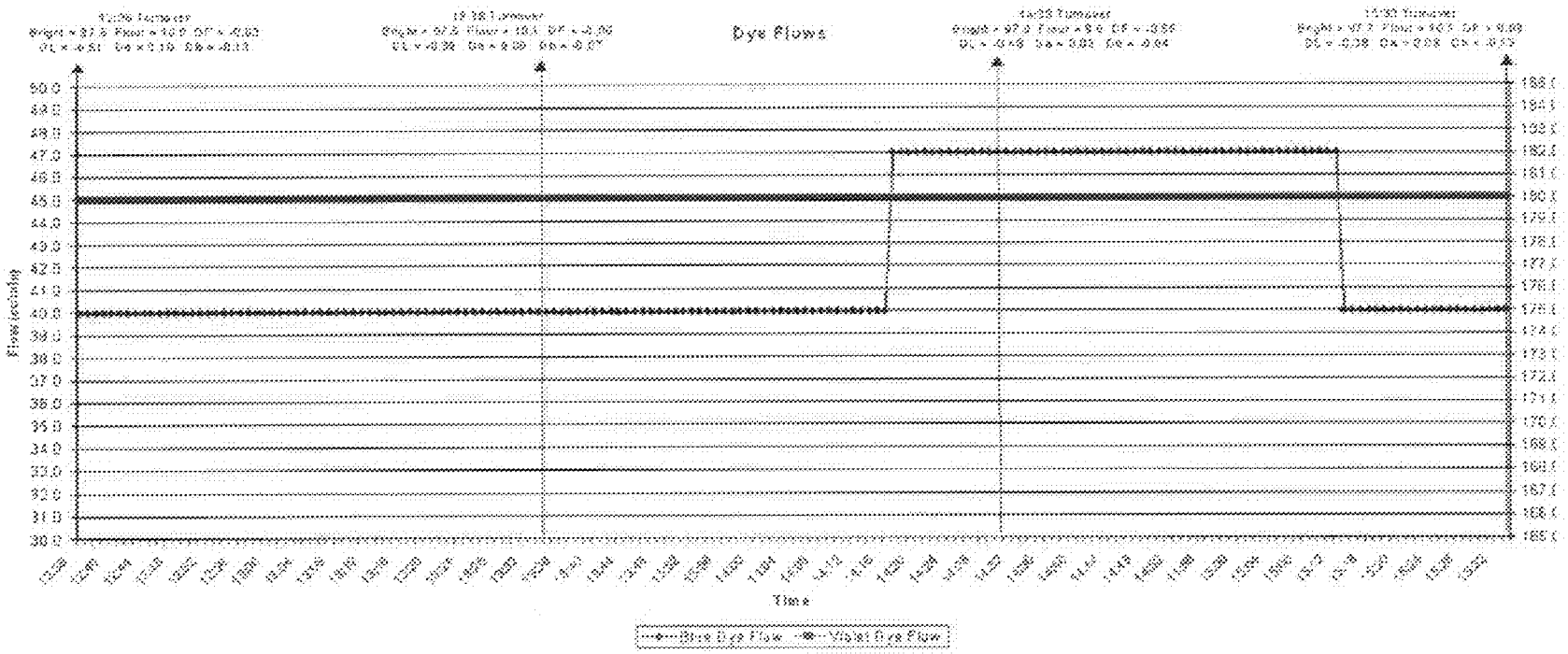
FIG. 3 is a third graphical representation of the effect of a reducing agent on OBA activation.

FIGS. 1-3 illustrate the results of the trial and in particular on-line color, OBA consumption, and dye usage.

The following are key results after producing the same paper without the reducing agent. Sheet brightness decreased 0.5-0.7 points On-line fluorescence decreased 0.38 points Lab fluorescence decreased 0.52 points b-value increased, Blue dye flow increased from 40-47 cc/min (b-value still more yellow)

OBA usage increased 6#/ton; Still unable to achieve similar fluorescence or b-value The results indicate that the reducing agent provided a 0.5 to 0.7 point brightness gain and reducing both OBA and dye consumption. Without the reducing agent, to achieve the same effect required OBA consumption to increase 6#/ton and blue dye consumption by 18%. Optical properties still were not achieved with these increases, indicating that the actual OBA/dye increase is even greater.

Example 3

The first reducing agent trial was to manufacture a 96 brightness sheet by using a minimal amount of OBA in the wet end of the paper machine. Up until this run, a "normal" OBA strategy for the machine on 96 bright would be 20#/ton of OBA at the wet-end and 30#/ton at the size-press. During the 4/20 trial run, the machine was easily able to maintain a 96.0 sheet brightness with 5.0#/ton of OBA at the wet-end, and 30#/ton of OBA at the size-press. This represented a 75% (or 20#/ton) wet-end OBA reduction from previous runs.

During, another trial the machine again utilized 5#/ton of OBA at the wet-end, but needed 50#/ton of OBA at the size-press to reach 96 brightness without the reducing agent. This represented an increase of 20#/ton of size-press OBA from the 4/20 reducing agent trial run.

A second trial was run. The reducing agent was again dosed at 4#/ton to the size-press. A summary of this trial run follows:

To achieve a 96.0 sheet brightness without over-fluorescing the machine white-water, the reducing agent was dosed immediately upon beginning the grade change to the 96 brightness. The reducing agent was dosed to the size-press service tanks at 4#/ton beginning at 8:40AM. To start the change, size-press OBA levels were set to 50#/ton, and wet-end OBA was set to about 6.5#/ton. By the 9:49 turn-up, the paper-test brightness was at a 95.9 with a 9.3 fluorescence. The 10:42AM turn-up tested at a 96.4 brightness with a 9.6 fluorescence. At this point the wet-end OBA was reduced to 5#/ton, and the OBA to the size-press was being back off as well. By the 3:08PM turn-up, the sheet brightness tested at 97.1, and had a 9.9 fluorescence. Wet-end OBA levels were still at 5#/ton, but size-press OBA had been lowered to 40#/ton.

Given the excess sheet brightness and fluorescence over target specifications, OBA levels would have normally been reduced even further. They were not, however, due to inconsistent size-press OBA flows. Through the afternoon and evening, there were several upsets in dye flow that had large impacts on fluorescence and brightness. Even with these inconsistent OBA flows, sheet brightness was averaging a 96.25 over the 18 hour period prior to machine runnability issues. Based on these OBA flows, this run represented a 10#/ton OBA reduction from the 96 bright run made without the reducing agent.

The reducing agent was again dosed at 4#/ton. Wet-end OBA levels averaged around 5#/ton and the size-press OBA was dosed at 30#/ton. These OBA levels represent a 20#/ton (or 40% ) size-press OBA reduction from previous runs without reducing agent.

Table 3 is a summary of the OBA usage during the past four 96 bright runs.

TABLE 3

| | | Wet-End OBA | Size-Press OBA |
|---|---|---|---|
| 1 | runs with-out REDUCING AGENT | 20# | 30# |
| 2 | w/REDUCING AGENT | 5# | 30# |
| 3 | with-out REDUCING AGENT | 5# | 50# |
| 4 | w/REDUCING AGENT | 5# | *40# |
| 5 | w/REDUCING AGENT | 5# | 30# |

*OBA dosage issues, brightness above target

Based on this run-to-run summary, we can see the benefit that the *OBA dosage issues, brightness above target is providing in terms of OBA reduction. It has allowed for a 15#/ton (75% ) reduction of wet-end OBA. Or, when comparing the four most recent runs that have limited the wet-end OBA to 5#/ton, it has reduced the size-press OBA by an average of 17#/ton.

We also see a large benefit in utilizing the reducing agent as a means of minimizing the amount of anionicity that is in your machine wet-end and broke furnishes. Trial run conditions and charge testing indicate that reducing agent allows for replacing up to 20#/ton of a highly anionic additive with only 4#/ton of a slightly anionic additive (reducing agent has ¼ the negative charge as the OBA's).

TABLE 4

Mixed kraft-CTMP 3, headbox

| # | Treatment | Br | Gain vs. Control | Gain vs. OBA |
|---|---|---|---|---|
| 1 | Control | 85.47 | 0 | |
| 2 | 0.2% OBA | 89.78 | 4.31 | 0 |
| 3 | 0.2% OBA + 0.2% Composition A | 91.05 | 5.58 | 1.27 |
| 4 | 0.2% OBA + 0.054% Sodium Metabisulfite | 90.6 | 5.13 | 0.82 |
| 5 | 0.054% Sodium Metabisulfite | 86.31 | 0.84 | |

Tables 4 illustrates the effect of a reducing agent sodium bisulfite (metabisulfite) on brightness in presence of an OBA (Table 5).

TABLE 5

4. CHELANT-METABISULFITE COMPOSITIONS
Kraft hardwood pulp 3, headbox

| # | Treatment | Br |
|---|---|---|
| 1 | 0% OBA 2 | 87.56 |
| 2 | 0% OBA 2 + 0.1% Composition C | 88.07 |
| 3 | 20% OBA | 92.08 |
| 4 | 20% OBA + 0.1% Composition C | 92.80 |
| 5 | 40% OBA | 93.05 |
| 6 | 40% OBA + 0.1% Composition C | 93.60 |
| 7 | 100% OBA | 93.43 |
| 8 | 100% OBA + 0.1% Composition C | 93.95 |

TABLE 6

Mixed kraft-CTMP 3, activation of an optical brightener

| # | Treatment | Br | Gain vs. Control | Synergism |
|---|---|---|---|---|
| 1 | Control | 85.48 | 0 | N/A |
| 2 | 0.2% Composition C | 86.79 | 1.35 | N/A |
| 3 | 0.2% OBA | 89.7 | 4.21 | N/A |
| 4 | 0.35% OBA | 90.73 | 5.22 | N/A |
| 5 | 0.1% Composition C | 86.34 | 0.81 | N/A |
| 6 | 0.2% OBA + 0.2% Composition C | 91.4 | 5.82 | 0.26 |
| 7 | 0.2% OBA + 0.1% Composition C | 90.78 | 5.25 | 0.23 |
| 8 | 0.35% OBA + 0.2% Composition C | 92.55 | 6.87 | 0.30 |
| 9 | 0.35% OBA + 0.1% Composition C | 92.06 | 6.54 | 0.51 |

TABLE 7

Activation of an optical brightener: kraft pulp 4, Composition C (0, 0.2%) with OBA (0, 0.2%)

| | Br | vs. (0, 0) |
|---|---|---|
| OBA1 | | |
| C0, OBA0 | 78.24 | 0 |
| C0, OBA0.2 | 79.74 | 1.5 |
| C0.2, OBA0 | 80.43 | 2.19 |
| C0.2, OBA0.2 | 82.53 | 4.29 |
| Synergism | | 0.6 |

TABLE 8

Mixed kraft-CTMP 1, headbox, activation of an optical brightener as measured by fluorescence intensities:

| Sample | Fluoresc. Intensity |
|---|---|
| Control | 33746 |
| 0.2% Composition. A | 36149 |
| 0.35% OBA | 106233 |
| 0.1% Composition A + 0.35% OBA | 111609 |
| 0.2% Composition A + 0.35% OBA | 116373 |
| 0.3% Composition A + 0.35% OBA | 119845 |

TABLE 9

Kraft headbox containing OBA, activation of an optical brightener as measured by fluorescence intensities:

| Sample | Fluoresc. Intensity |
|---|---|
| Control | 87140 |
| 0.1% Composition A | 106217 |
| 0.2% Composition A | 108942 |
| 0.2% OBA | 117513 |
| 0.2% Composition A + 0.2% OBA | 120837 |

TABLE 10

Mixed furnish (25% softwood, 40% hardwood kraft, 35% deinked), activation of an optical brightener as measured by fluorescence intensities:

| Sample | Fluoresc. Intensity |
|---|---|
| Control | 57121 |
| 0.2% Composition A | 57567 |
| 0.91% OBA | 61339 |
| 0.2% Composition A + 0.6% OBA | 60783 |
| 0.2% Composition A + 0.45% OBA | 60868 |
| 0.2% Composition A + 0.3% OBA | 59924 |

Tables 4-10 illustrate application of compositions where a reducing agent is combined with chelant(s). This set of data demonstrates an OBA activation by the compositions. Applying the formulation allows cutting the dose of an optical brightener.

Wet end application: separate application of the composition on pulp that leads to increased performance of OBA applied later.

Pulp Application Procedure (80° C.) for Subsequent OBA Enhancement

TABLE 11

Kraft 6

| # | % Composition A | % OBA | Br | Gain vs. Control |
|---|---|---|---|---|
| 1 | 0 | 0 | 86.78 | 0.00 |
| 2 | 0 | 0.5 | 88.70 | 1.92 |
| 3 | 0 | 0.25 | 88.22 | 1.44 |
| 4 | 0.5 | 0 | 88.05 | 1.27 |
| 5 | 0.5 | 0.5 | 91.04 | 4.26 |
| 6 | 0.50 | 0.25 | 89.38 | 2.60 |
| 7 | 0.25 | 0.25 | 90.55 | 3.77 |

TABLE 12

Kraft 6

| # | % Composition G | % OBA | Br | Gain vs. Control |
|---|---|---|---|---|
| 1 | 0 | 0 | 86.64 | 0.00 |
| 2 | 0.5 | 0.5 | 91.66 | 5.02 |
| 3 | 0.5 | 0.25 | 90.69 | 4.05 |
| 4 | 0.25 | 0.25 | 89.32 | 2.68 |
| 5 | 0 | 0.5 | 89.00 | 2.36 |
| 6 | 0.5 | 0 | 87.68 | 1.04 |

TABLE 13

Kraft 6, activation of an optical brightener as measured by fluorescence intensities:

| Sample | Fluoresc. Intensity |
|---|---|
| Control | 7871 |
| 0.5% Composition G | 10370 |
| 0.5% OBA | 128578 |
| 0.5% Composition G, then 0.5% OBA | 201199 |
| 0.25% Composition G, then 0.5% OBA | 161354 |
| 0.5% Composition G, then 0.25% OBA | 157359 |
| 0.5% Composition A, then 0.5% OBA | 191759 |

Tables 11-13 illustrate activation of an OBA via prior application of a composition.

While this invention may be embodied in many different forms, there described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and/or incorporated herein. In addition the invention encompasses any possible combination that also specifically excludes any one or some of the various embodiments described herein and/or incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method of activating an optical brightening agent, the method comprising the steps of:

contacting an optical brightening agent with a reducing agent before the optical brightening agent is added to pulp in the wet end of a papermaking process or tissue making process wherein the reducing agent is in an amount of 0.05 to 2% on oven-dried pulp.

2. The method of claim 1 in which the reducing agent is one selected from the list consisting of: sulfites, bisulfites, metabisulfites (pyrosulfites), sulfoxylates, thiosulfates, dithionites (hydrosulfites), polythionates, formamidinesulfinic acid and salts and derivatives thereof, formaldehyde bisulfite adduct and other aldehyde bisulfite adducts, sulfinamides and ethers of sulfinic acid, sulfenamides and ethers of sulfenic acid, sulfamides, phosphites, and thiophosphites and wherein said bisulfites are selected from monobasic metal salts of sulfurous acid and said sulfites are selected from dibasic metal salts of sulfurous acid provided said reducing agents are not used in combination with an acid of formula:

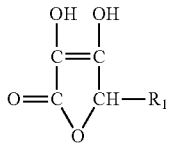

where $R_1$=—$CHOHCH_2OH$ or —CHOHCOOH, or salts thereof.

3. The method of claim 2 in which the optical brightening agent is added to lignin free bleached kraft pulp material.

4. The method of claim 3 in which the optical brightening agent is added to bleached kraft pulp material in a papermaking or tissue making process (a) before or after the fan pump to the paper machine headbox; (b) to the paper machine white water.

5. The method of claim 1 in which additional reducing agent is added after a wet-end of the papermaking process is complete.

6. The method of claim 1 in which the reducing agent chemically alters at least one quenching group in the paper such that the quenching group absorbs less of the light that is emitted by the optical brightening agent.

7. The method of claim 6 in which the quenching group is a carbonyl group in the hemicellulose component of the pulp.

8. The method of claim 1 in which the paper is made from bleached pulp.

9. The method of claim 1 in which the paper is made from non-bleached pulp.

10. The method of claim 2 in which the reducing agent is one selected from the list consisting of: metabisulfites (pyrosulfites), sulfoxyiates, thiosulfates, dithionites (hydrosulfites), polythionates, formamidinesulfinic acid and salts and derivatives thereof, formaldehyde bisulfite adduct and other aldehyde bisulfite adducts, sulfinamides and ethers of sulfinic acid, sulfenamides and ethers of sulfenic acid, sulfamides, phosphites, and thiophosphites.

* * * * *